US011034037B1

(12) United States Patent
Frances

(10) Patent No.: US 11,034,037 B1
(45) Date of Patent: Jun. 15, 2021

(54) RAZOR HEAD WITH BLADE LOCATION INDICATOR

(71) Applicant: Arnold Frances, Delray Beach, FL (US)

(72) Inventor: Arnold Frances, Delray Beach, FL (US)

( * ) Notice: Subject to any disclaimer, the term of this patent is extended or adjusted under 35 U.S.C. 154(b) by 0 days.

(21) Appl. No.: 17/002,235

(22) Filed: Aug. 25, 2020

(51) Int. Cl.

| | |
|---|---|
| ***B26B 21/40*** | (2006.01) |
| ***B26B 21/06*** | (2006.01) |
| ***B26B 21/22*** | (2006.01) |
| *B26B 21/44* | (2006.01) |

(52) U.S. Cl.
CPC ..... *B26B 21/4012* (2013.01); *B26B 21/06* (2013.01); *B26B 21/222* (2013.01); *B26B 21/4043* (2013.01); *B26B 21/443* (2013.01)

(58) Field of Classification Search
None
See application file for complete search history.

(56) References Cited

U.S. PATENT DOCUMENTS

| | | | | |
|---|---|---|---|---|
| 5,062,209 | A | 11/1991 | Rais | |
| 5,388,331 | A | 2/1995 | Doroodian-shoja | |
| 6,460,251 | B1 | 10/2002 | Orloff | |
| 6,708,408 | B2 | 3/2004 | Orloff | |
| 7,739,797 | B2 * | 6/2010 | Rawle | B26B 21/4043 30/34.1 |
| 2002/0000041 | A1 | 1/2002 | Doroodian-shoja | |
| 2002/0189102 | A1 | 12/2002 | Orloff | |
| 2020/0156272 | A1 | 5/2020 | De Vries et al. | |

FOREIGN PATENT DOCUMENTS

| | | | |
|---|---|---|---|
| EP | 0740596 | | 5/2001 |
| GB | 2461337 | * | 9/2012 |

* cited by examiner

*Primary Examiner* — Hwei-Siu C Payer
(74) *Attorney, Agent, or Firm* — Leason Ellis LLP

(57) ABSTRACT

A razor cartridge includes an outer housing and one or more blades disposed within the outer housing. In addition, the razor cartridge includes at least one blade location indicator disposed along one or more surfaces of the outer housing for identifying a location of one respective blade within the outer housing.

22 Claims, 6 Drawing Sheets

RAZOR HEAD WITH BLADE LOCATION INDICATOR

TECHNICAL FIELD

The present invention relates to razors and more particularly, relates to a razor head or replaceable blade cartridge or disposable razor that includes one or more blade location (position) indicators that are located along the razor head (cartridge) including, but not limited to, front, side and/or back faces of the cartridge.

BACKGROUND

As is widely known, a razor is a bladed tool primarily used in the removal of body hair through the act of shaving. Both women and men use razors. Today, the most common type of razor is a safety razor which is a modern blade razor that consists of a specially designed blade or blades mounted in a metal or plastic shell that is attached to a handle. This kind of razor can be designed as a refillable cartridge which can accept new blades or as a disposable unit which is intended to be thrown away after the blade becomes dull.

Razor blades are periodically exposed to high levels of moisture and therefore must be made from a special corrosion resistant steel alloy. Furthermore, the grade of steel must be hard enough to allow the blade to hold its shape, yet malleable enough to allow it to be processed. The preferred type of steel is called carbide steel because it is made using a tungsten-carbon compound.

The plastic portions of a safety razor typically include the handle and blade cartridge, or portions thereof, depending on the razor design. These parts are typically molded parts.

As mentioned, the head or cartridge of a safety razor typically holds a plurality of razor blades that are held within the surrounding plastic blade cartridge (head). There are still single blade constructions especially for disposable razors.

For men, razors are most often used to shave facial hair. Two of the challenges to shaving facial hair are shaving the sideburns to a desired length such that the two sideburns are of equal length and creating a neatly groomed beard or stubbles. Sideburns are facial hair grown on the sides of the face, extending from the hairline to run parallel to or beyond the ears. Shaving is typically performed using a mirror and shaving of the sideburns is performed by placing the razor generally in a vertical orientation on top of the respective sideburn and then shaving in a downward direction. More recently, neatly groomed beards or stubbles have become very common. These beards are sometimes sharply shaped with clean cuts on the face, chin and neck. It is very important to have the capability to cut these hairlines smoothly with little to no discontinuities whether shaving vertically or horizontally or any angle whatsoever whether shaving one section (blade width) at a time perpendicular to the beard line or shaving parallel to and following the beard line.

For women, razors are most often used to shave underarm and leg hair. More recently, clean, sharp cuts in the bikini area have become more important.

SUMMARY

A razor cartridge according to the present disclosure includes an outer housing and one or more blades disposed within the outer housing. The razor cartridge further includes at least one blade location indicator disposed along the outer housing for identifying a location of one respective blade within the outer housing. The outer housing is typically rectangular shaped with a forward wall, an opposing rear wall, first and second side walls that extend between the forward and rear walls and as well as between a front face that is placed in contact with the skin and an opposing rear face. The blade location indicator thus provides a visual guide to the user as to where at least one blade is located and this allows the user to position the razor cartridge more precisely on the face. This is particularly helpful when trying to shave the sideburns and/or a beard since it is difficult to cut the sideburns to the desired length and difficult to cut a smooth beard line without understanding the precise location of the cutting edge of the blade (i.e., both the blades' edges and height within their cartridge).

BRIEF DESCRIPTION OF THE DRAWING FIGURES

DETAILED DESCRIPTION OF CERTAIN EMBODIMENTS

Figure 2A:
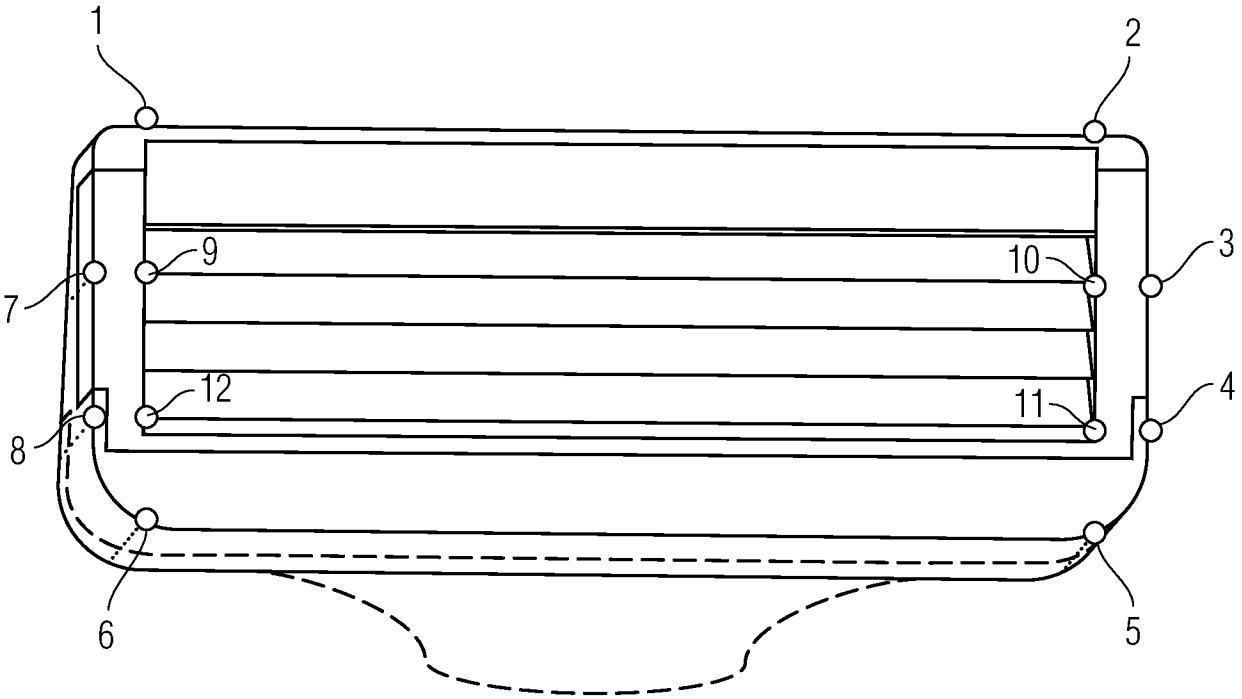
FIG. 2A is a front perspective view of the razor cartridge.
Figure 2B:
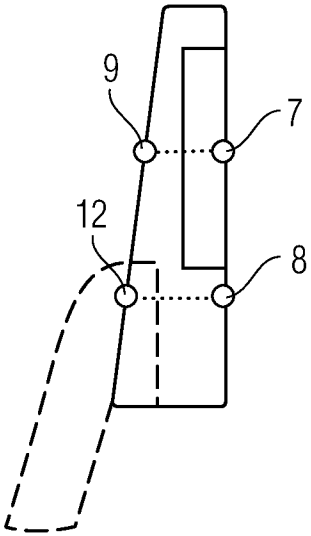
FIG. 2B is a side elevation view thereof.
Figure 3:
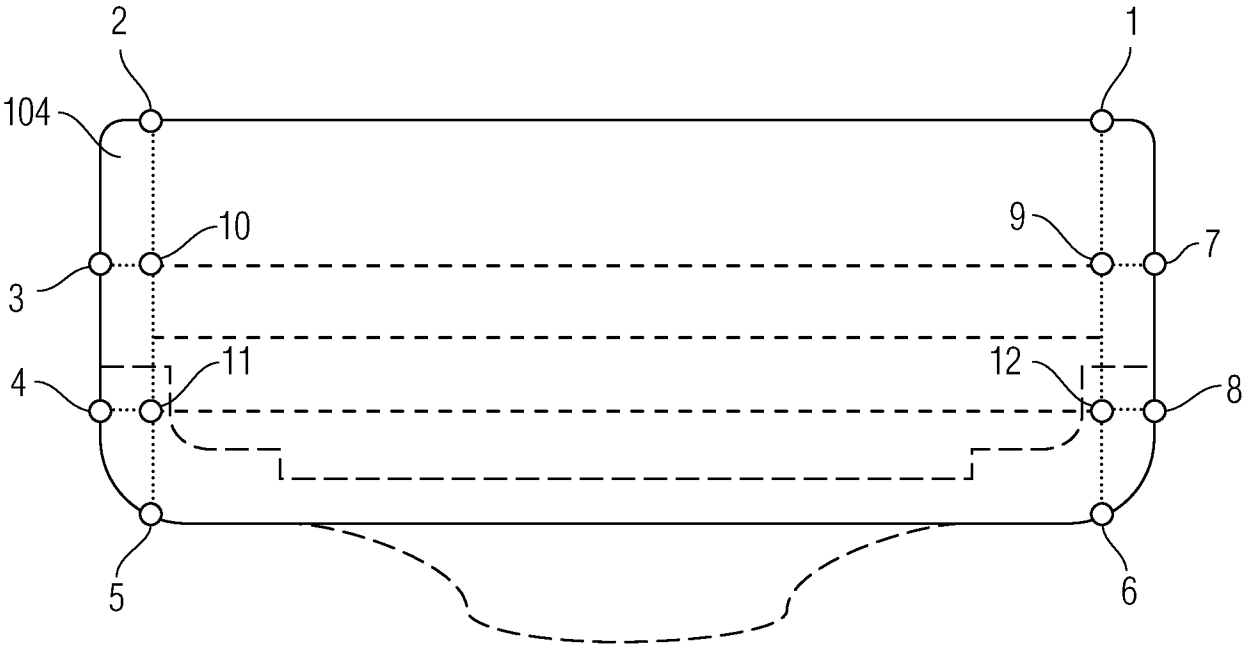
FIG. 3 is a rear elevation view of the razor cartridge.

FIGS. 1-3 illustrate a razor cartridge 100, according to one exemplary embodiment, that includes one or more blades 110 and an outer housing 120 in which the one or more blades 110 are set and contained. The outer housing 120 is thus the structure that surrounds and envelopes the blades 110 and can be formed of a single structure or two or more parts that are attached to one another to form an assembled outer housing 120 with the blades 110 captured within the outer housing 120. The razor cartridge 100 can also be referred to as being a razor head. As is known, the razor cartridge 100 is detachably attached to a razor handle (not shown) or in the event of a disposable razor, the razor cartridge 100 comprises an integral razor head that is permanently attached to the razor handle.

The razor cartridge 100 generally has a front surface (front face) 102 across which the one or more blades 110 are exposed and is for placement on the skin, an opposite rear surface (rear face) 104 (FIG. 3), a first (forward) wall (forward edge) 105, an opposite second (rear) wall (rear edge) 106, a first side wall (first end) 107 and an opposite second side wall (second end) 108. In some razor blade constructions, the first side wall (first end) 107 and the second side wall (second end) 108 can be in the form of end caps or the like. In a traditional generally rectangular shaped razor cartridge 100, as shown, when the razor is oriented in a vertical orientation with the handle of the razor extending downwardly, the first wall 105 comprises a forward wall, the second wall 106 comprises a rear wall; the first side wall 107 can also be considered to be a first end wall; and the second side wall 108 can also be considered to be a second end wall, with the lengths of the side walls 107, 108 being less than the lengths of walls 105, 106.

Within the outer housing 120, each blade 110 is set at an angle and includes a leading blade edge that is sharpened and serves to cut the body hair. The opposite edge of the blade can be referred to as a trailing edge.

The outer housing 120 is traditionally formed by a molding process in which the outer housing 120 is molded over the blades 110.

Modern razor cartridges include a lubrication component in that many razors include a lubrication strip 200 that is found above the blades 110 in the outer housing 120. The strip 200 has absorbent properties and typically the strip 200 holds a formula with water-loving polymers which are released from the strip with each shaving stroke. When these polymers come into contact with water, they swell, unfold, and stretch along the user's skin, adding lubrication to the shave. The lubrication strip 200 is exposed along the front face 102 and is proximate the forward wall 105.

To shave, the razor cartridge 100 is positioned on the skin and then moved across the skin area which is intended to have the hair removed therefrom. When shaving a sideburn (bottom or side) or stubbles, the razor cartridge 100, along with the handle, is generally held in a vertical position with the first (forward) wall 105 being oriented higher than the second (rear) wall 106 and then the razor is moved in downward direction to effectuate a cutting action. When shaving a beard, the razor can be held in any position to follow the beard line. The shaving can proceed perpendicular to the beard or hair line in steps one next to the other, or parallel to the beard or hair line, exactly following its edge.

Blade Location Indicator

In accordance with the present disclosure, each razor cartridge 100 includes one or more blade location indicators 300 (which can also be referred to as being a blade marker). Each blade location indicator 300 is located along one or more of the first side wall 107 and the second side wall 108 and/or the first (forward) wall 105 and the second (rear) wall 106 or can be located along the rear face 104, or a combination thereof. Each blade location indicator 300 serves to identify the location of one respective blade 110 within the outer housing 120 to allow the user to immediately ascertain the location of the blade 110 when the razor cartridge 100 is placed against the user's skin. As described in more detail herein, by knowing the precise location of at least one of the blades 110 or knowing the region of the cartridge in which plural blades are located, the user can position this blade 110 against the sideburn at the precise trim location to which the sideburn is to be trimmed. Similarly, by knowing the precise location of at least one of the blades 110 and more specifically the side edge of the blade, the user can precisely position that edge of the blades to align with the beard line whether shaving perpendicular or parallel to the beard line. The blade location indicator 300 thus provides a visual indicator or guide that eliminates the guess work in terms of where to position the razor blades 110 relative to the sideburn, beard line or other area to achieve the desired cut.

As described herein, the blade location indicator can be used to identify any location of the blade 110, such as the leading cutting edge, a rear edge, or an intermediate location (side edge) of the blade 110. Thus, it will be appreciated that while the blade location indicator may be pointing to one location of the blade in any given figures, the blade location indicator can equally be formed to point to another location of the blade.

It will also be appreciated that the blade location indicator 300 is preferably limited to only the area at which the one or more blades 110 is located and does not extend into surrounding areas (beyond the footprint of the blade(s)). For example, the blade location indicator 300 located along side walls 107, 108 does not extend into the area in which the lubricating strip 200 is located and likewise does not extend into areas of the outer housing that contain no blades 110. The blade location indicator 300 should thus be located only at an area along the outer housing that contains one or more blades 100 so as to allow the location of the blade(s) to be identified easily in a visual manner. As described herein, the blade location indicator 300 can serve to identify a location of a certain edge of the blade, such as a cutting edge. Similarly, along the forward and/or rear wall, the blade location indicator(s) is located at both ends of the blade and/or located between the ends of the blade(s) but is not present at locations at which the blade(s) is not located. In other words, since each blade does not extend completely across from side wall 107 to side wall 108, the blade location indicator 300 likewise does not extend completely from side wall 107 to side wall 108.

FIGS. 2A, 2B and 3 depict exemplary locations for blade location indicators that can be provided along the housing 120 of the razor cartridge. For ease of simplicity, each of these exemplary locations for one blade location indicator is indicated with a number. In FIGS. 2A, 2B, and 3, there are a total of twelve exemplary locations for placement of the blade location indicators and these twelve locations are numbered 1 to 12.

It will be understood that the razor cartridge 100 does not need to include all of the blade location indicators at all of the locations 1-12 but rather can include a selected subset thereof. As described in more detail below, the locations 1-8 are on the outer edge of the razor cartridge 100 (e.g., on the rear face 104 and/or on the side edges 107, 108) for identifying precisely where the sharp edges of blades 110 are located both vertically (locations 3, 4, 7, 8) showing their locations height wise, top to bottom in the cartridge for shaving perpendicular to a sideburn and/or beard line, and marker locations 1, 2, 5, 6 clearly showing the edges (ends) of the blades 110 which are required to shave a beard line precisely with a continuous motion parallel to that beard line. In other words, along one side wall of the outer housing, the locations 3 and 4 define the region at which the sharp edges of the blades 110 are located. The sharp edges of the blades 110 are located between the locations 3 and 4. The blade location indicators at these locations 3 and 4 thus visually identify the zone or region in which the sharp edges of the blades 110 are located. Similarly, the locations 7 and 8 on the other side wall of the outer housing perform the same function.

In other words, along the forward wall 105 of the outer housing, the locations 1 and 2 are located at ends of the blades 110 and therefore, the blades 110 are located between the locations 1 and 2. Thus, by viewing the forward wall and viewing either separate blade location indicators at the locations 1 and 2 or a single blade location indicator (e.g., a continuous color band) between the locations 1 and 2, the user will readily understand that the blades 110 are located between these locations 1 and 2. Similarly, the locations 5 and 6 along the rear wall 106 identify the locations of the ends of the blades 110. Thus, the user will immediately understand the precise locations of the blades 110 as being between locations 5 and 6. Similar to the forward wall, the blade location indicator 300 along the rear wall 106 can either be separate blade location indicators at the locations 5 and 6 or a single blade location indicator (e.g., a continuous color band) between the locations 5 and 6.

Locations 9-12 are located on the rear face 104 of the cartridge 100 and thus are visible in a mirror when the front face is against the skin. It will be appreciated that the area between locations 3 and 4 can be thought of as being a blade containing section of the cartridge 100 and therefore, the blade location indicators at the locations 3, 4 define the forward edge and the rear edge of the cutting area of the blades contained in the blade containing section of the cartridge 100. As shown, the location 3 is at a cutting edge of one blade (e.g., a forwardmost blade or top blade) when the razor is oriented vertically with handle extending downwardly and the location 4 is at a cutting edge of another blade (e.g., a rearwardmost blade or bottom blade).

Similarly, on the rear face 104 of the outer housing, the blade containing section is defined between the locations 10 and 11 and between the locations 9, 12. In other words, the markers 9-12 are placed exactly over the four corners (of the blade containing section) formed by the lengthwise edges of the topmost and bottommost blades at their cutting edges. These locations define all four corners of the actual cutting edges of the blades and is the only set of markers that described herein than can be used to position the razor for either perpendicular strokes (1 or as many side by side strokes as required) or for shaving parallel to any hair line for a continuous, sharp cut.

Figure 5:
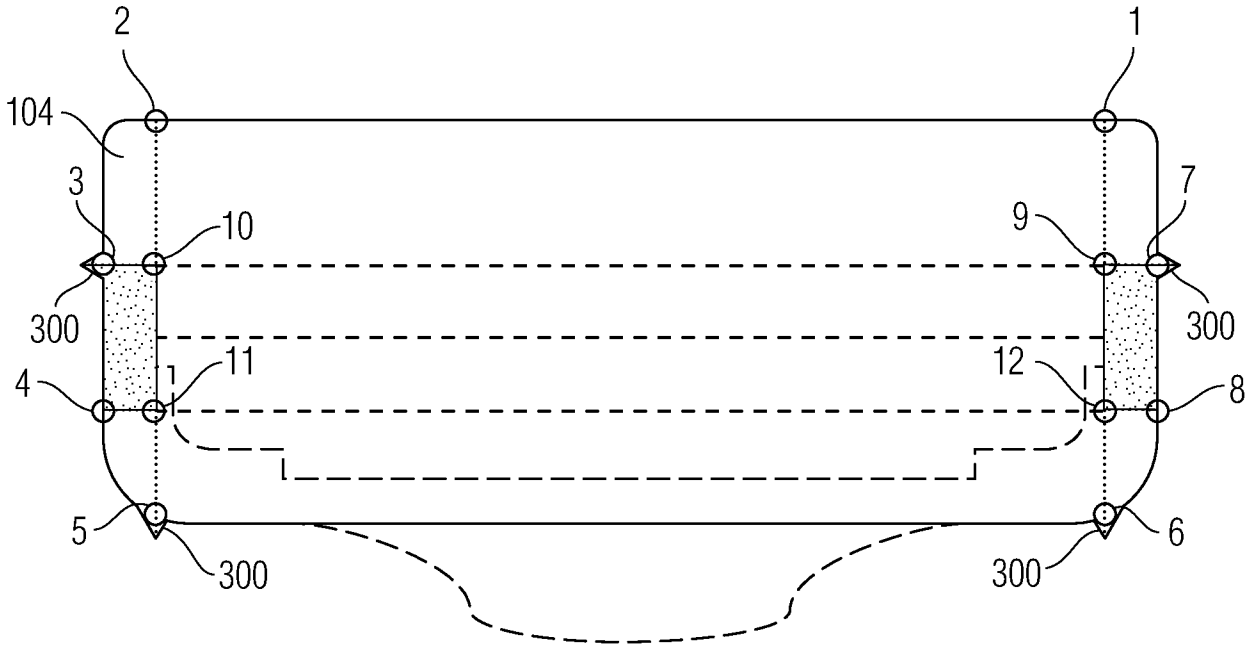
FIG. 5 is a rear elevation view of another embodiment of the razor cartridge.

As described herein, to visually identify this cutting area of the blade containing section (defined between locations 9-12), this area of the outer housing can be formed of a different color than the color of the outer housing that lies outside of this color band. Thus, at each of the locations 9-12, a separate, discrete blade location indicator can be provided, such as a line or dot or take another form described herein, or a continuous color band can located on the rear face between the locations 10 and 11 and another continuous color band can be located between locations 9 and 12 as shown in FIG. 5. The stippling represents an area that is visually identifiable relative to the surrounding sections of the outer housing.

Similarly, other locations of the outer housing 120 can contain such color band to act as a blade location indicator. For example, the area between locations 3 and 4 can be a colored band that defines the areas between cutting edges of two different blades such as the forwardmost (top) blade and the rearwardmost (bottom) blade. Alternatively, as discussed herein, this blade containing section can be identified by a pair of discrete marks that identify for forward and rearward extent of the blades. FIG. 4A shows this type of arrangement with the color band being shown with stippling which represents an area that is visually identifiable relative to the surrounding sections of the outer housing.

It will therefore be appreciated that the blade location indicator can thus, be in the form of a color band that identifies a region in which the blades are located or it can be in the form of discrete markings that identify a specific location of one blade and/or define the outline (peripheral edge) of the region in which the blades are located. Generally, the area of interest is the area between the cutting edge of one blade (forwardmost blade) and the cutting edge of another blade (rearwardmost blade).

The blade location indicator 300 can take any number of different forms so long as the blade location indicator is easily and quickly identifiably and is generally in the form of a mark or some other type of indicia that is immediately and visually identifiable from the surrounding housing. For example, these blade location indicators 300 can be protrusions, bumps, indentations, grooves, or raised, indented, or colored lines, dots circles change of color, or any other mark or indicator that show the location of one or more blades. Thus, the blade location indicator 300 can be at least one of a visual cue to the user and a tactile cue to the user. Blade location indicators at locations 9, 10, 11, 12 must be on the rear face of the cartridge. All the other indicators are located on the outer perimeter of the cartridge (e.g., the forward wall, rear wall, side walls). These can extend anywhere from the rear face of the cartridge to the front face. For example, as shown, the indicators can be flush with and lie in the same plane as the front face. Having the marker, whether it be a color, line, a slight protrusion, or whatever extend to or be at the face could add additional accuracy as would be touching the skin being shaved.

Figure 4C:
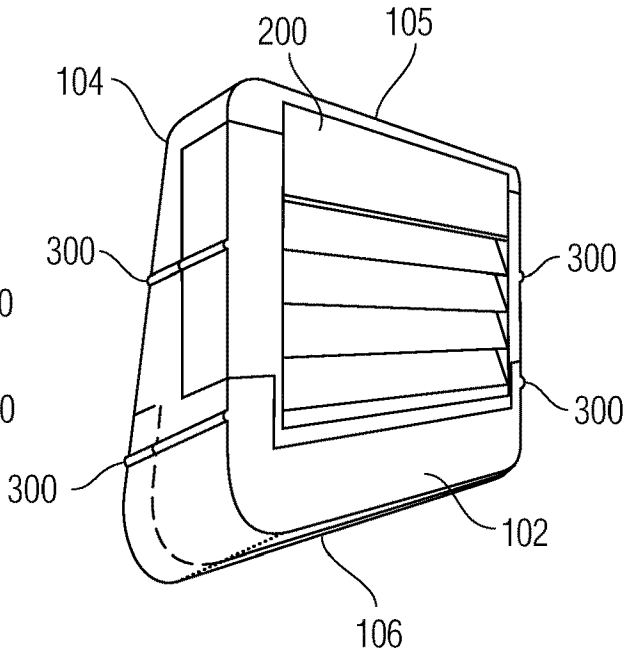
FIG. 4C is a side perspective view of one razor cartridge showing blade location markings according to a first embodiment.
Figure 4B:
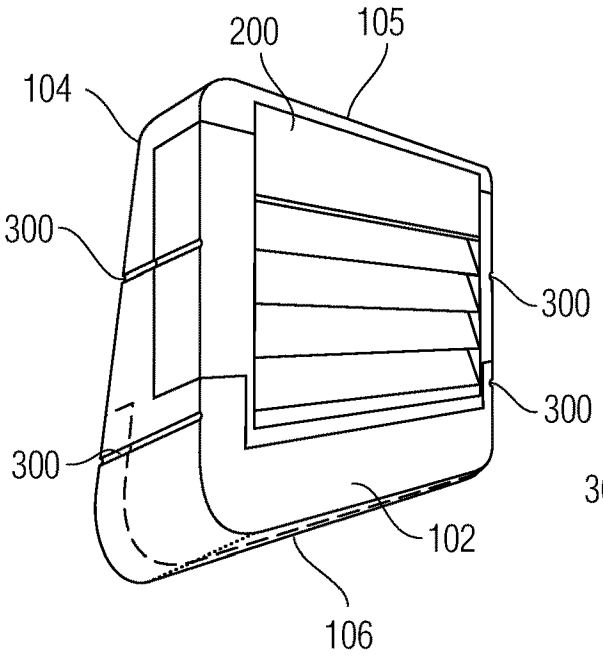
FIG. 4B is a side perspective view of one razor cartridge showing blade location markings according to a first embodiment.
Figure 4A:
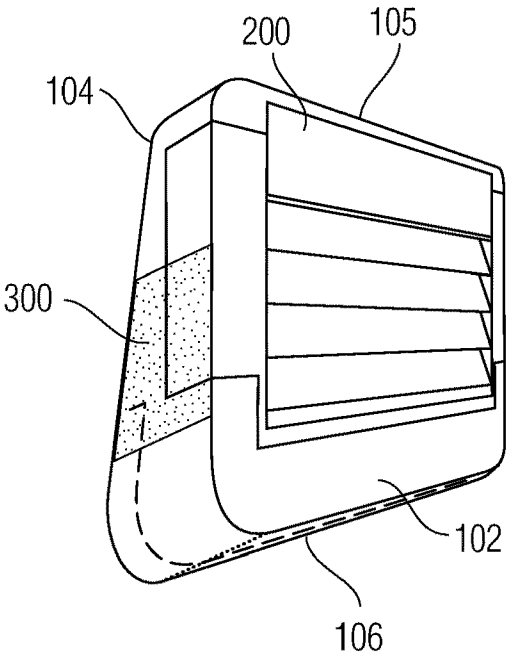
FIG. 4A is a side perspective view of one razor cartridge showing blade location markings according to a first embodiment.

FIG. 4B shows blade location indicators 300 in the form of grooves or channels formed in the outer housing, while FIG. 4C shows blade location indicators 300 in the form of raised rails formed along the outer housing. As shown, in each of FIGS. 4B and 4C, each blade location indicator marks the cutting edge of one blade. It will be seen that in FIGS. 4B and 4C, the blade location indicator extends completely along the respective side wall 107, 108 from the front face 102 to the rear face 104. Thus, one end of the blade location indicator 300 (e.g., the rail of FIG. 4C) is flush with and forms part of the front face 102 (i.e., the end lies in the plane of the front face) and similarly, the other end of the blade location indicator 300 is flush with and forms part of the rear face 104 (i.e., the end lies in the plane of the rear face). The blade location indicators 300 are typically integrally formed (by a common molding process) with the rest of the outer housing.

Figure 6A:
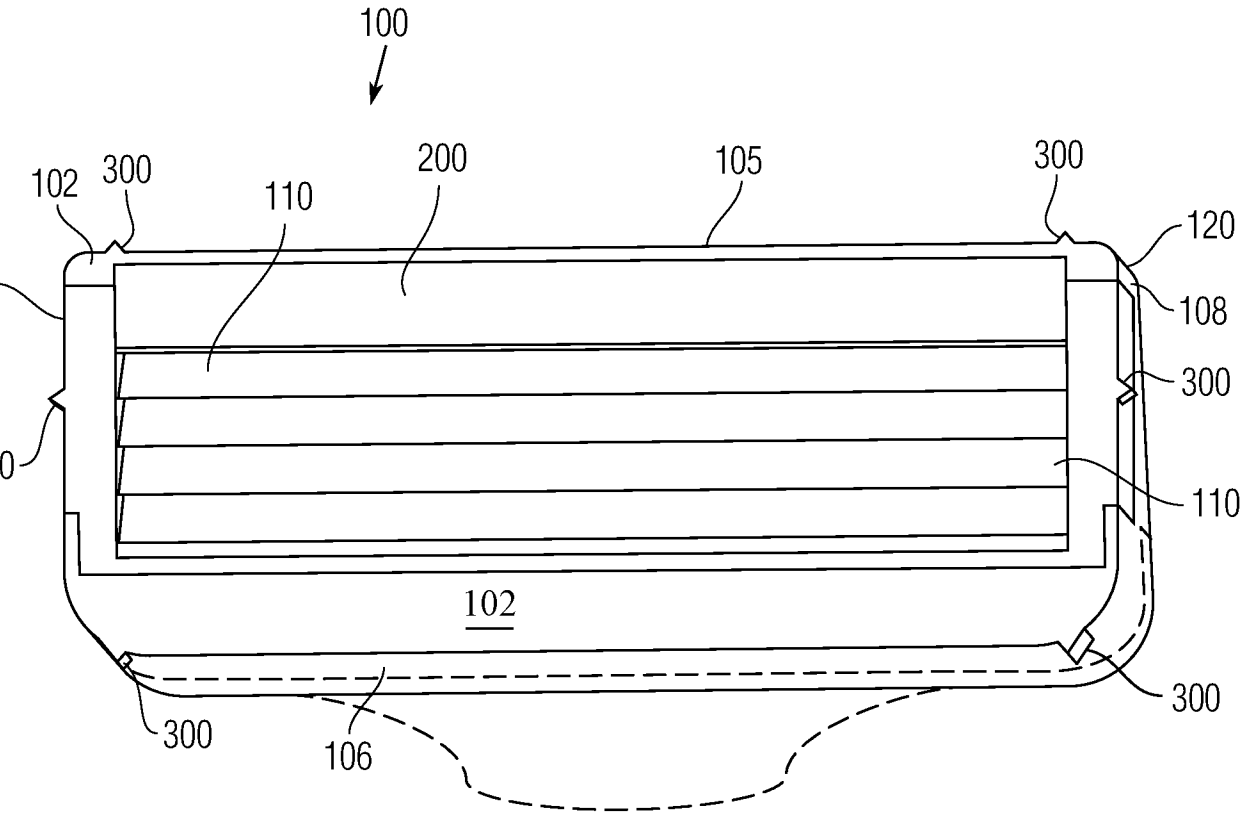
FIG. 6A is a front perspective view of a razor cartridge according to another embodiment.
Figure 6B:
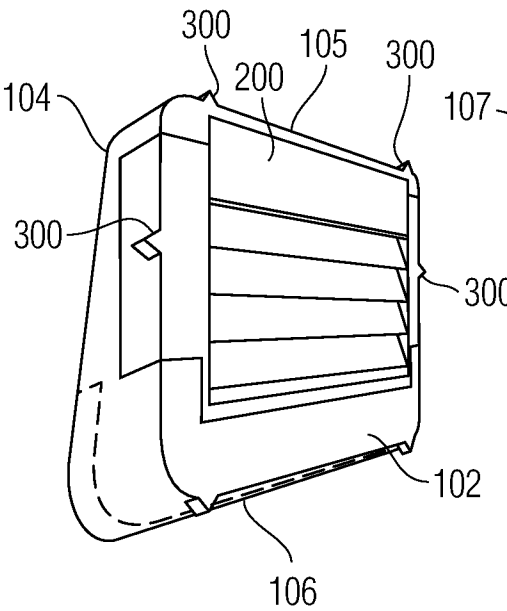
FIG. 6B is a side perspective view thereof.

In contrast, FIGS. 6A and 6B shows another embodiment in which the blade location indicators 300 are in the form of protrusion that do not extend completely along the respective wall from the front face 102 to the rear face 104. Instead, the blade location indicator 300 only extends rearward a short distance from the front face 102. The blade location indicator 300 is flush with and forms part of the front face 102 as shown. The blade location indicators 300 in FIGS. 6A and 6B generally take the form of a pointed protrusion (e.g., a triangular shaped protrusion) that extends outwardly from one respective wall of the outer housing. For example, the blade location indicators 300 can be located at any of the locations described herein along the sides 107, 108; the forward wall 105 and the rear wall 106. For illustration purposes only, FIGS. 6A and 6B show one blade location indicator 300 along the side wall 107, one blade location indicator 300 along the side wall 108, a pair of blade location indicators 300 along the forward wall 105 and a pair of blade location indicators 300 along the rear wall 106. It will be understood that the blade location indicators 300 do not have to be at all of these locations but instead can be at select locations (such as only along the side walls 107, 108 or only along the forward wall 105 and rear wall 106 or a combination thereof). It will also be understood the distance the blade location indicator 300 travels along the respective wall can vary so along as the blade location indicator 300 is robust and structurally sound and does not easily snap off the outer housing. As discussed herein, the blade location indicator 300 serves to identify the location of at least one respective blade 110 and in particular, can identify one section of the blade, such as a cutting edge or an end of the blade both of which are shown in FIGS. 6A and 6B. In one embodiment, the pointed blade location indicator has a color that is different than a color of the at least one of the forward wall, the rear wall, the first side wall and the second side wall from which the pointed blade location protrudes.

Figure 1A:
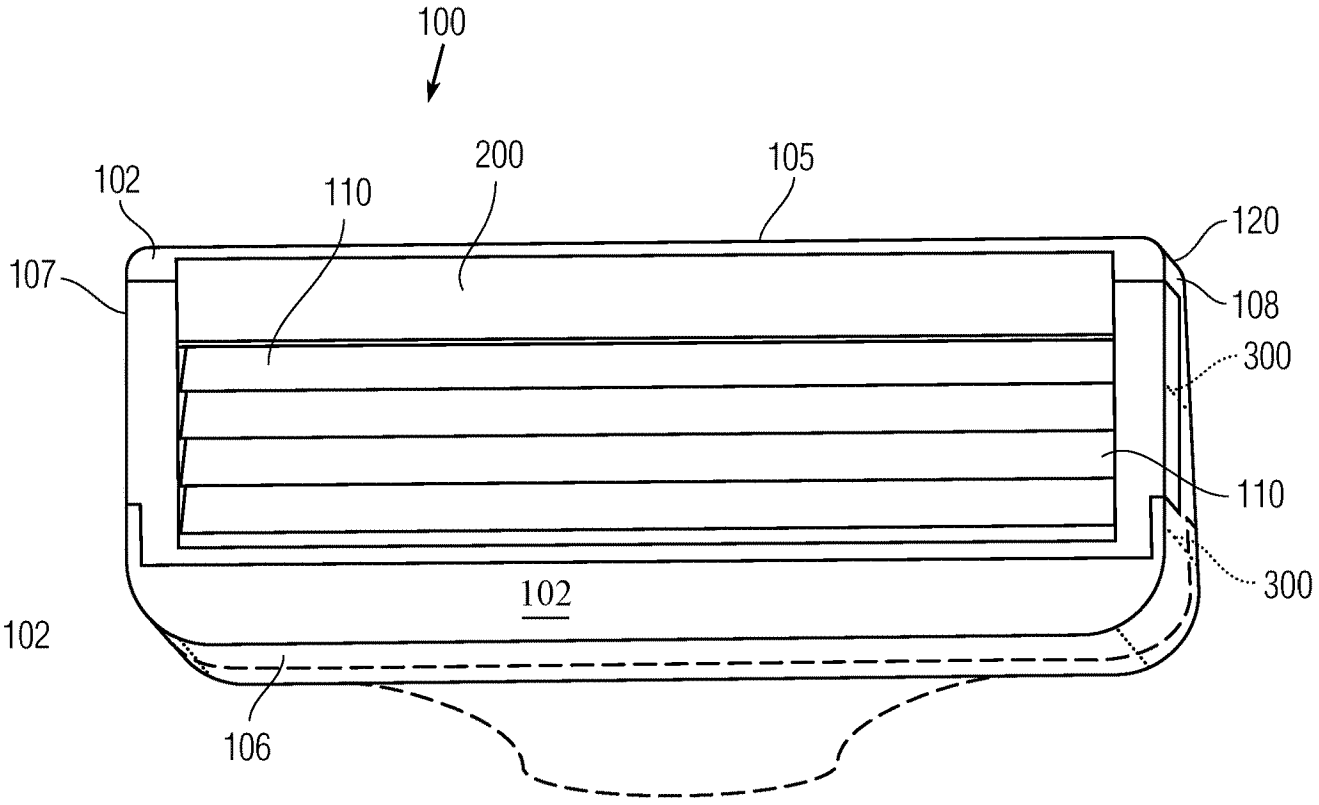
FIG. 1A is a front perspective view of a razor cartridge according to a first embodiment.
Figure 1B:
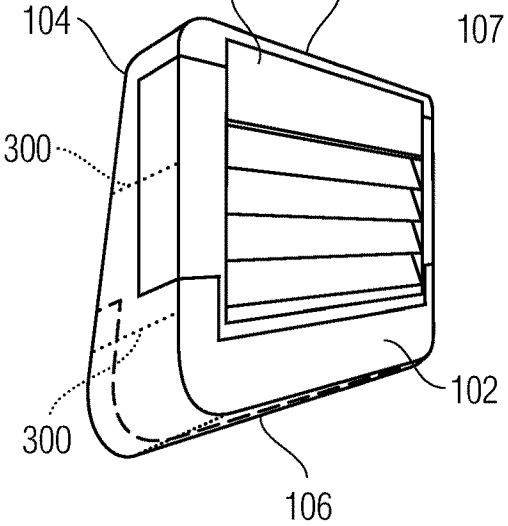
FIG. 1B is a side perspective view thereof.

For example, as shown in FIG. 1B, the blade location indicator 300 can take the form of a line on one of and preferably both of the first side 107 and the second side 108 (FIG. 1A). The line can be formed in a color (e.g., a bright color) that is in contrast to the color of the outer housing 120 on which is it applied. The line can be a solid line or it can be a dashed line. Alternatively, the indicator 300 can take the form of a dot or a series of colored dots or other graphic and/or physical indicia. The blade location indicator 300 can thus located along the first side 107 and the second side 108 at the precise location of the leading, cutting edge of the blade 110. The blade location indicator(s) 300 can also be located along ends of the blades 110, namely locations 1, 2, 5, 6 in FIG. 3.

The blade location indicator 300 can also be in the form of a transition between two colored regions of the outer housing 120. For example, the outer housing 120 can have two colors with a transition between the colors marking the location of the leading edge of the blade 110. For example, in FIG. 1B, the area below the line 300 can be a first color and the area above the line 300 can be a different second color. Alternatively, a region in which the blades 110 are located can be colored different compared to the color of the surrounding housing. For example, each of the sides 107, 108 can have a first color in an area (region) in which the blades 110 are located (See, FIG. 4A) and the surrounding regions of the sides 107, 108 can have a different second color. For example, the surrounding regions can have a gray color, while the first color that defines the area in which the blades are located can have a bright color (e.g., red). From forward to rearward along each side wall 107, 108 and/or walls 105, 106, there would be three distinct color bands in this embodiment, namely, a rear gray colored band, the red colored band and then a forward gray colored band. By knowing the region in which the cutting edges of the blades 110 are located, the user can quickly position the razor cartridge at a desired location along the body by simply viewing the relative position of this colored region relative to the body.

The same colored bands can be located along the forward wall 105 (between locations 1 and 2) and the rear wall 106 (between locations 5 and 6) of the cartridge 100 to identify the location of the blades.

In the event that the cartridge 100 includes a plurality of blades 110, there can be a corresponding number of blade location indicators 300. Each of these blade location indicators 300 can be visually identifiable from the other ones. For example, the different blade location indicators 300 can be different colors and/or they can take different forms, such as a line vs. dots, etc. When there are a plurality of blade location indicators 300, each blade location indicator 300 marks the location of one corresponding blade 110 or at least one part of the blade, such as a cutting edge of the blade.

Alternatively, and/or combination with one of the blade location indicators described herein, the blade location indicator 300 can be placed on the rear surface 104 that is visible during the shaving process as shown in FIG. 3. As with all other embodiments, the blade location indicator 300 is placed at the location of one corresponding blade 110 and in particular, can be placed at the location of the leading edge of selected blades 110 such as the forwardmost and rearwardmost blades. For example, to identify one blade 110, the blade location indicator 300 can consist of a first mark formed at or near the interface between the rear surface 104 and the first side 107 and a second mark formed at or near the interface between the rear surface 104 and the second side 108. The first and second marks can take any number of different forms including the ones described herein. In addition, when combined with marks on the first side 107 and second side 108, the markings for one blade can be different between the marking on the rear surface 104 and the first side 107 and the second side 108. For example, the rear surface 104 can include a pair of dots of a first color and the corresponding markings on the first side 107 and the second side 108 can be in the form of a pair of lines having the first color. In this way, all of the markings indicating the location of the same blade are colored coordinated. Each blade can thus be assigned one color. The user can thus view the razor cartridge 100 from either the rear surface 104 and/or the first side 107 and second side 108.

FIG. 5 is similar to FIG. 6 and illustrates another embodiment in which at locations 5 and 6 along the rear wall 106 there are blade location indicators 300 in the form of protrusions that extend rearwardly away from the rear wall 106. In FIG. 5, there protrusions have the shape of a cone or a triangle (arrowhead shape) and the protrusions can be formed along the entire height of the rear wall 106 or they can be formed at a discrete location along the rear wall 106. It will also be understood that these arrowhead shaped protrusions shown along the rear wall 106 can also be included along the forward wall 105 at locations 1 and 2 and optionally can be located along one or both the side walls at locations 3, 4 and/or 7, 8. As shown in FIG. 5, it will be appreciated that the pointed arrow shaped protrusion can be located at any one and/or at a selected set of the locations 1-12. As described herein, FIG. 6 has a similar construction and is described hereinbefore.

In one embodiment, a series of dots that identify the location of plural blades 110 that are contained in the cartridge. To identify the different blades, the dots can be grouped as a first group identifying a cutting edge of the first blade; a second group identifying a cutting edge of the second blade, etc. The different groups of dots can be formed in different colors, shapes and/or sizes to visually differentiate one blade from the other.

The present disclosure thus discloses the placement of any sort of mark(s), indicator(s) or other indicia showing the user exactly where one or more of the cutting blades are located. The simplest marking would be a line, dot, color change, protrusion, or anything else on one or preferably both sides of the cartridge or blades to clearly show exactly where one or more of the blades are located making it much easier to get both sideburns the same length and a nice smooth, even beard line. These can be on the surface of the back (rear face 104) of the blade cartridge and/or on the four edges of the cartridge.

One would expect the top (forwardmost) blade 110 (the one closest to the lubricant strip) in the cartridge to define the shaved edge, but if the blade/cartridge is not firmly placed correctly on the face, it's possible that the cut may be defined by the second or third blades in the blade stack 110. This would not cause a problem since the cut would leave more hair than expected and can be corrected, however, in one embodiment the location of all the blades can be marked or at least the top and bottoms blades 110.

Furthermore, if one is shaving to the cutting edge as could be the case when shaving the beard line under one's chin or neck, it would be advantageous to place similar markings on the front and rear edges and/or the front and rear ends on the back of the cartridge (e.g., locations identified by numbers 3, 4, 7, 8 in FIG. 3) or locations that are identified by numbers, 9, 10, 11, 12 in FIG. 3 that are on the back (rear face 104) of the cartridge 100. A group of all four numbers are required to cover parallel shaving above and below the beard line and from one side to the other.

It will once again be understood that one or more of the locations 1-12 can contain one of the blade location indicators 300 that are described herein or a single blade location indicator can be identified between two locations (e.g., between 1 and 2).

It is to be understood that like numerals in the drawings represent like elements through the several figures, and that not all components and/or steps described and illustrated with reference to the figures are required for all embodiments or arrangements.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not precludes the presence or addition of one or more other features, integers, steps, operations, elements, components, and/or groups thereof.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

The subject matter described above is provided by way of illustration only and should not be construed as limiting. Various modifications and changes can be made to the subject matter described herein without following the example embodiments and applications illustrated and described, and without departing from the true spirit and scope of the present invention, which is set forth in the following claims.

What is claimed is:

1. A razor cartridge comprising:

an outer housing including a front face that is for placement against skin of a user and an opposite rear face, the front face and the rear face extending between a first side wall and an opposite second side wall of the outer housing; and one or more blades disposed within the outer housing; and at least one blade location indicator disposed along the outer housing for identifying a location of one respective blade of the one or more blades within the outer housing;

wherein the at least one blade location indicator is located along one of the first side wall and the second side wall and extends in a direction perpendicular to both the front face and the rear face.

2. The razor cartridge of claim 1, wherein the at least one blade location indicator comprises a first structure formed along one of the first side wall and the second side wall of the outer housing at a location of the one respective blade of the one or more blades, wherein the at least one blade location indicator has a surface that is flush with the front face of the outer housing.

3. The razor cartridge of claim 2, wherein the first structure is formed along at least one of the first side wall and the second side wall of the outer housing at a cutting edge of the one respective blade.

4. The razor cartridge of claim 3, wherein the first structure comprises a line formed along at least one of the first side wall and the second side wall of the outer housing.

5. The razor cartridge of claim 4, wherein the line has a color that is different than a color of surrounding portions of the outer housing.

6. The razor cartridge of claim 2, wherein the first mark comprises one or more dots formed along at least one of the first side wall and the second side wall of the outer housing, wherein the one or more dots have a color that is different than a color of surrounding portions of the outer housing.

7. The razor cartridge of claim 2, wherein the first structure comprises a first mark and wherein the one or more blades comprises at least a forwardmost blade and a rearwardmost blade, and the at least one blade location indicator further includes a second mark that is formed along the outer housing, the second mark being formed at a location of a cutting edge of the rearwardmost blade, while the first mark is formed at a location of a cutting edge of the forwardmost blade.

8. The razor cartridge of claim 7, wherein each of the first mark and the second mark are formed of a color that is different that a color of surrounding portions of the outer housing.

9. The razor cartridge of claim 1, wherein the one or more blades that are disposed within a blade section of the outer housing comprises a plurality of blades, and the at least one blade location indicator comprises four blade location indicators that are arranged in four corresponding corners of the blade section of the outer housing.

10. The razor cartridge of claim 9, wherein the four blade location indicators are located along the rear face of the outer housing and identify ends of the plurality of blades.

11. The razor cartridge of claim 1, wherein the one or more blades disposed within a blade section of the outer housing comprises a plurality of blades, and the at least one blade location indicator comprises: at least one of: (1) first and second forward blade location indicators located along a forward wall of the outer housing at ends of the plurality of blades; and (2) first and second rear blade location indicators located along a rear wall of the outer housing at the ends of the plurality of blades.

12. The razor cartridge of claim 11, wherein the first and second forward blade location indicators comprise two opposing ends of a first color band formed along the forward wall, and the first and second rear blade location indicators comprise two opposing ends of a second color band formed along the rear wall, each of the first color band and the second color band having a color that is different than a color of surrounding portions of the outer housing.

13. The razor cartridge of claim 1, wherein the at least one blade location indicator comprises a plurality of blade location indicators, one of which is disposed along one of the first side wall and the second side wall of the outer housing and another of which is located along the rear face of the outer housing, each blade location indicator only being located along the outer housing at a location that is adjacent the one respective blade.

14. The razor cartridge of claim 1, wherein the at least one blade location indicator disposed along the outer housing comprises a transition between a first color and a second color of the outer housing at a location that identifies the location of the one respective blade.

15. The razor cartridge of claim 1, wherein the at least one blade location indicator comprises a structure selected from the group consisting of: a protrusion, a bump, an indentation, a groove, a raised line, an indented line, a colored line, dots, circles, and a change of color.

16. The razor cartridge of claim 1, wherein the one or more blades comprises at least a forwardmost blade having a first leading cutting edge and a rearwardmost blade having a second leading cutting edge, and the at least one blade location indicator comprises a first blade location indicator formed along at least one of the first side wall and the second side wall of the outer housing at a location of the first leading cutting edge, and a second location indicator is formed along the at least one first side wall and the second side wall at a location of the second leading cutting edge, wherein adjacent sections of the first and second side walls in which the forwardmost and rearwardmost blades are not located have a different color than a color of each of the first location indicator and the second location indicator.

17. A razor cartridge comprising:

an outer housing; and one or more blades disposed within the outer housing; and at least one blade location indicator disposed along the outer housing for identifying a location of one respective blade of the one or more blades within the outer housing;

wherein the one or more blades comprises a forwardmost blade and a rearwardmost blade, and the at least one blade location indicator comprises a visually identifiable colored area to identify an area that extends from a cutting edge or an end of the forwardmost blade to a cutting edge or an end of the rearwardmost blade.

18. The razor cartridge of claim 17, wherein the visually identifiable colored area is formed on at least one of: (1) a side of the outer housing when the colored area extending from the cutting edge of the forwardmost blade to the cutting edge of the rearwardmost blade and (2) a rear face of the outer housing when the colored area extends from one end to an opposite end of at least one of the forwardmost blade and the rearwardmost blade.

19. A razor cartridge comprising:

an outer housing having a forward wall, an opposing rear wall, a first side wall and an opposing second side wall, each of the first side wall and the second side wall extending between the forward wall and the rear wall, the outer housing further including a front face that is for placement against skin of a user and an opposite rear face; and a plurality of blades disposed within the outer housing in a blade receiving space that is located between the forward wall, the rear wall, the first side wall and the second side wall, the plurality of blades being exposed along the front face;

at least one pointed blade location indicator that is integrally formed with the outer housing and protrudes outwardly from at least one of the forward wall, the rear wall, the first side wall and the second side wall, wherein a point of the pointed blade location indicator aligns with at least one edge of at least one blade of the plurality of blades for identification thereof, the at least one pointed blade location indicator being flush with and defining part of the front face of the outer housing.

20. The razor cartridge of claim 19, wherein a height of the pointed blade location indicator is less than a height of the at least one of the forward wall, the rear wall, the first side wall and the second side wall from which the pointed blade location indicator protrudes.

21. The razor cartridge of claim 19, wherein the pointed blade location indicator has a color that is different than a color of the at least one of the forward wall, the rear wall, the first side wall and the second side wall from which the pointed blade location indicator protrudes.

22. The razor cartridge of claim 19, wherein the at least one edge comprises one of a cutting edge of the at least one blade and an end of the at least one blade.

* * * * *